US007471803B2

(12) United States Patent
Tanoni

(10) Patent No.: US 7,471,803 B2
(45) Date of Patent: Dec. 30, 2008

(54) INTEGRATED ELECTRO ACOUSTIC EQUIPMENT WITH PORTABLE COMPACT CONSTRUCTION FOR SOUND APPLICATIONS

(75) Inventor: Bruno Tanoni, Recanati (IT)

(73) Assignee: F.B.T. Elettronica S.p.A., Recanati (MC) (IT)

( * ) Notice: Subject to any disclaimer, the term of this patent is extended or adjusted under 35 U.S.C. 154(b) by 282 days.

(21) Appl. No.: 10/594,001

(22) PCT Filed: Mar. 14, 2005

(86) PCT No.: PCT/IT2005/000140

§ 371 (c)(1),
(2), (4) Date: Sep. 25, 2006

(87) PCT Pub. No.: WO2005/094117

PCT Pub. Date: Oct. 6, 2005

(65) Prior Publication Data

US 2007/0177751 A1 Aug. 2, 2007

(30) Foreign Application Priority Data

Mar. 26, 2004 (IT) ..... MC2004A0049

(51) Int. Cl.
*H04R 25/00* (2006.01)

(52) U.S. Cl. ..... 381/386; 381/334; 381/335

(58) Field of Classification Search ..... 381/87, 381/300, 301, 304, 305, 332–335, 386, 387, 381/388, 345, 189, 391, 182; 181/199; 62/457.1, 62/457.7; 455/351, 350, 347
See application file for complete search history.

(56) References Cited

U.S. PATENT DOCUMENTS 4,843,624 A * 6/1989 Rashak ..... 381/91
5,781,853 A * 7/1998 Johnson ..... 455/351
6,968,067 B2 * 11/2005 Lopez ..... 381/334

* cited by examiner

*Primary Examiner*—Huyen D Le
(74) *Attorney, Agent, or Firm*—Hodes, Pessin & Katz, P.A.; Robert M. Gamson; Ruth F. Vadi

(57) ABSTRACT

The present invention refers to an integrated electro acoustic equipment, characterised by the fact that it uses the parallelepiped case of the main loudspeaker for low frequencies, suitably provided with wheels for easier handling and transportation, as structure to contain all components of the equipment—such as audio mixer, power unit and two satellites for the reproduction of medium and high frequencies—together with electrical connections.

5 Claims, 6 Drawing Sheets

INTEGRATED ELECTRO ACOUSTIC EQUIPMENT WITH PORTABLE COMPACT CONSTRUCTION FOR SOUND APPLICATIONS

The present patent application refers to an integrated electro acoustic equipment with portable compact construction for sound applications.

As it is known, it is very often necessary to provide sound diffusion in closed or open environments through traditional electro-acoustic equipment.

A similar need is felt by musicians and also by those who need to speak in public to small or large audiences.

In particular, the electro acoustic equipment may consist in a loudspeaker for the reproduction of low frequencies and two two-way diffusers (normally known as satellites) for the reproduction of medium and high frequencies, assisted by amplifiers. An additional element of the said equipment consists in an audio mixer connected with the aforementioned diffusers and with specific acoustic sources (microphones, musical instruments, etc.) whose sound must be diffused in the environment.

This type of traditional equipment has become quite popular due to high reliability and functionality.

However, the use of this type of equipment is impaired by the difficulties encountered during transportation, installation and connection of the different elements.

Obviously, transportation and installation problems become especially critical in the presence of very powerful electro acoustic systems that included large and heavy acoustic diffusers.

In this case, handling requires the work of several individuals and possibly the use of a trolley or similar suitable means.

The need to overcome these problems has resulted in the development of the integrated electro acoustic equipment of the invention, which is characterized by reduced volume (at least when not used), practical transportation and simple electrical connections.

The present invention is based on the idea of using the parallelepiped case of the main speaker, that is to say the low frequency speaker, as support and/or container for all the other components of the electro acoustic system.

As a matter of fact, traditionally the front of the case acts as resonance case for the speaker; the back of the case has two spaces, one above the other one, in which the two satellites designed to co-operate with the speaker can be housed and held in position by means of a suitable cover.

Obviously, the two satellites must be maintained in this position only when transporting the equipment of the invention or when the equipment is not used. On the contrary, when they are used, the two satellites can be easily removed and placed in the most convenient position for operation.

The audio mixer is integrated on the top of the main case and protected (when not used) by a boxed-type wall that can rotate by approximately 90° with respect to the upper transversal edge of the case.

More precisely, the wall can be moved from the horizontal position, in which it hides and protects the audio mixer, to a basically vertical position, in which it can be also used to pull the case, being suitable provided (as if it were a trolley) of a pair of wheels mounted on the bottom horizontal wall.

As mentioned earlier, the main advantage of the new equipment is also represented by the advantageous modes provided to connect the various components.

To that end, it must be noted that the main case also houses the wires that are used to connect the power unit both to the audio mixer and main speaker in a suitably recessed position.

Likewise, it must be noted that the main case has an additional space below the two satellites, which is designed to contain the power unit with heat dissipator.

The panel of the power unit, which closes the aforementioned space, is provided with the electrical socket and two connectors for the two satellites.

It must be said that by connecting the electrical power cable to the socket, the audio mixer, the power amplifier associated with the main speaker and the two power amplifiers associated with the satellites are powered simultaneously.

This first concise description clearly shows the high functionality of the equipment of the invention; as a matter of fact, the user can have all the components of an electro-acoustic system for sound applications in a compact structure with regular shape and reduced volume, which is especially useful when the system is not used or during transportation.

On the other hand, the weight of the integrated equipment of the invention is no longer a problem, since the equipment can be pulled thanks to the presence of wheels.

Likewise, the use of the invention is extremely advantageous: in view of the internal wires, in order to prepare the equipment of the invention for use, the user only needs to remove the two satellites from the case and make the electrical connection between the case and the satellites, in addition to the connection between the case and the external electrical mains.

For major clarity the description of the invention continues with reference to the enclosed drawings, which only have an illustrative, not limiting purpose, in which.

Figure 1:
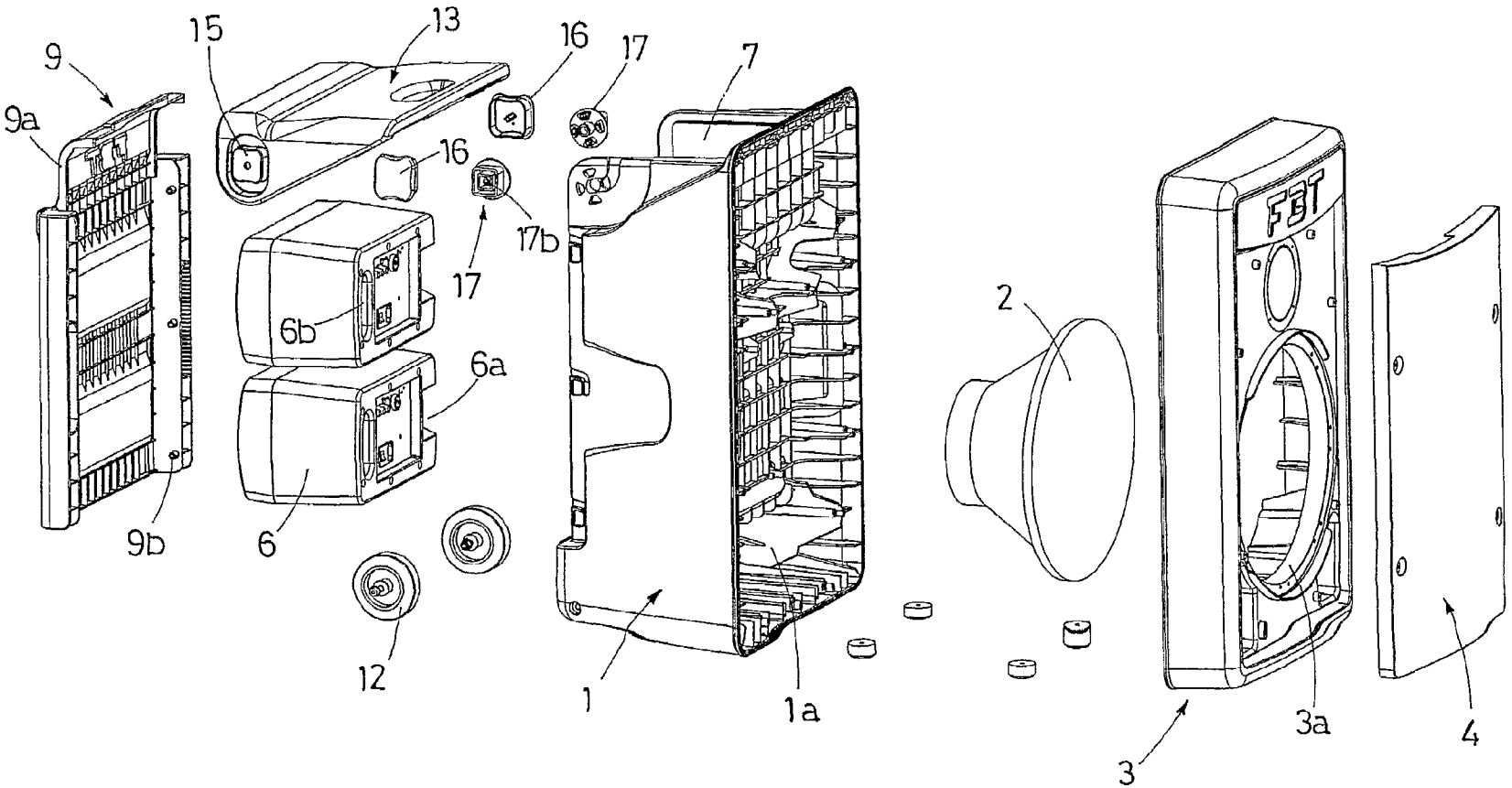
FIG. 1 is an exploded axonometric view of the electro acoustic equipment of the invention.

With reference to the enclosed figures, the integrated equipment of the invention is composed of a large parallelepiped case (1) that is frontally provided with a space (1*a*) having the same height as the case (1), which partially houses a speaker (2) for the reproduction of low frequencies and designed to be closed by a suitable box-shaped cover (3) with opening (3*a*), in which the speaker (2) is inserted and fixed, with a grid (4).

The back of the case (1) is provided with two identical spaces (5), one above the other one, which can exactly contain the two satellites (6) in horizontal position.

Two bulges (5*a*, 5*b*) are located on the bottom vertical wall of each space (5), the first with horizontal direction and the second with vertical direction, both having a frontally tapered profile, which are designed to exactly penetrate inside corresponding niches (6*a*, 6*b*) on the back of the satellites (6) when the satellites (6) reach the stop limit inside the spaces (5).

The matching between the bulges (5*a*, 5*b*) of the spaces (5) and the niches (6*a*, 6*b*) of the satellites (6) favors the centering of the satellites (6) with respect to the spaces (5) and avoids uncontrolled dangerous movements of the satellites (5) when handling the equipment (1).

An additional housing (7) is located above the spaces (5) on top of the case (1), which is designed to exactly house an audio mixer (8).

When the equipment of the invention is not used, a panel (9) is used to close the two spaces (5), thus preventing the accidental release of the satellites (6) and forming the back of the housing (7) used for the audio mixer (8).

To that end, the panel (9) has an upper wing (9*a*) basically folded at 90° inwards, which is suitable to "embrace" the first rear section of the housing (7) of the audio mixer (8).

On internal side of the uprights, the closing panel (9) is provided with pegs (9*b*) with horizontal axis, suitable to couple with corresponding slots (1*b*) with overturned-L shape located on the external sides of the case (1).

An additional space (10) is located below the two spaces (5) for the satellites, which is designed to contain the power unit with heat dissipator (D).

The panel (10*a*) of the power unit, which closes the space (10), is provided with the electrical socket (10*b*) and two connectors (10*c*) for the two satellites (6).

Two small housings (11) with vertical direction are located in lateral position with respect to the space (10), in which wheels (12) are fixed by means of suitable pins with horizontal axis.

The front space (1*a*) of the main case (1) also houses a cable (CE) in recessed position, used to make the electrical connection between the audio mixer (8) housed in the upper space (7) and the power unit housed in the lower space (10), which is also connected to the speaker (2) by means of an internal connection (not shown in the enclosed figures).

A special boxed-type cover (13) is pivoted on top of the main case (1) in external position on the lateral sides of the space (7) that houses the audio mixer (8). The free transversal border of the boxed-type cover (13) has a notch (14) that can be used as handle.

In particular, the cover (13) consists in a closing wall (13*a*) and two lateral borders (13*b*) with basically triangular shape and decreasing height from the rear to the front.

Figure 7:
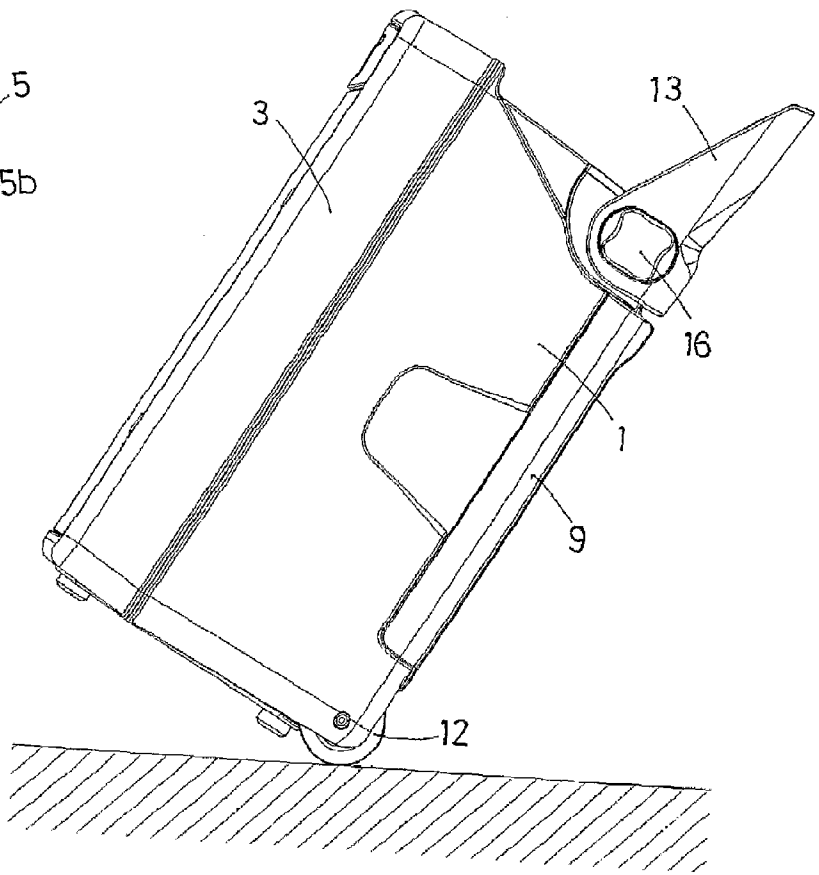
FIG. 7 is a side view of the equipment of the invention showing the position of the equipment while it is pulled.
Figure 2:
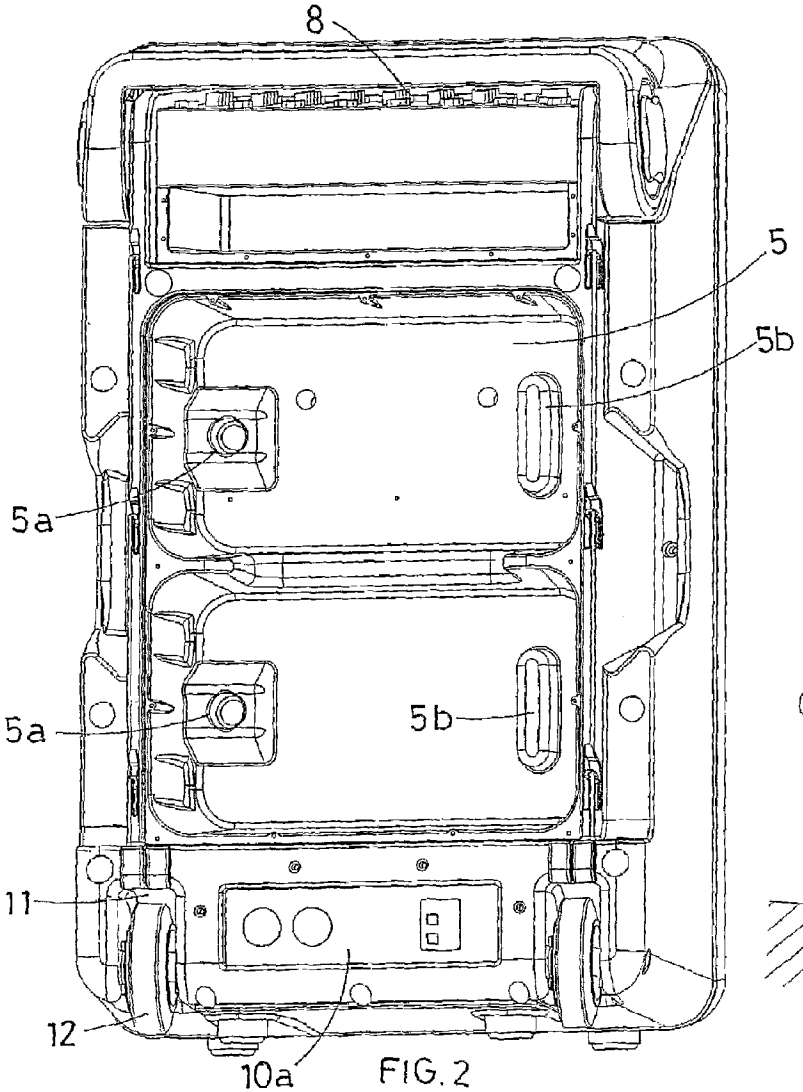
FIG. 2 is an axonometric view of the back of the main case of the electro acoustic equipment of the invention, without cover.
Figure 3:
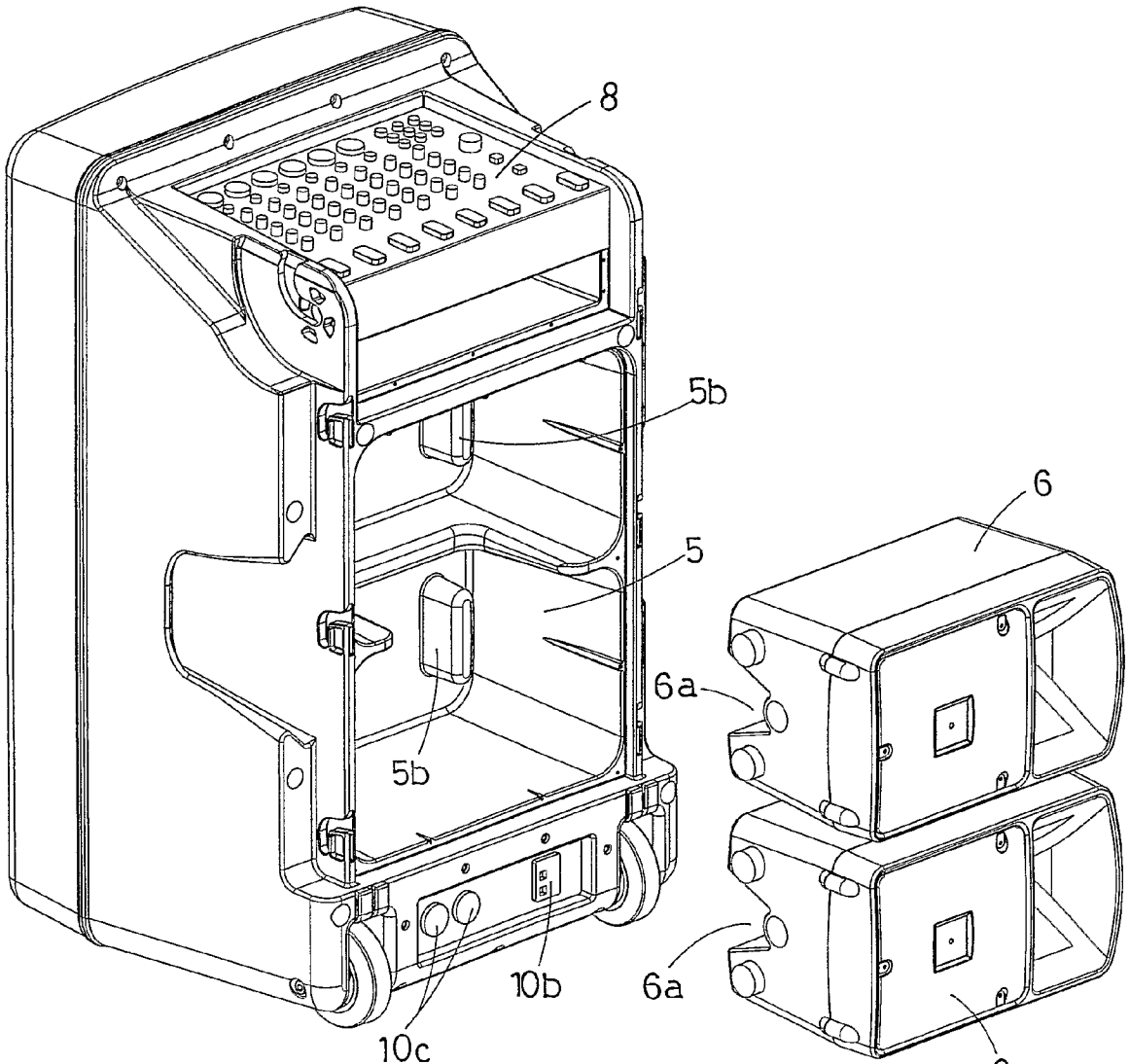
FIGS. 3 and 4 are axonometric views of the back of the case and satellites, showing the satellites before and after they are positioned in the case.
Figure 5:
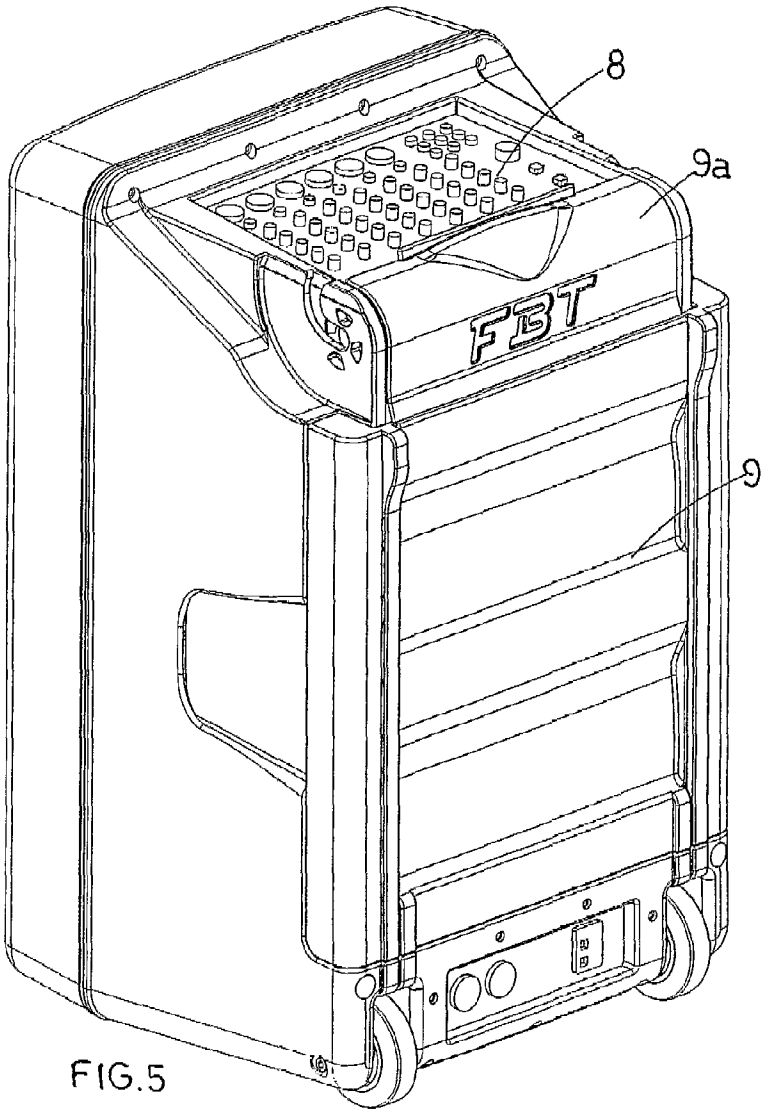
FIG. 5 is an axonometric view of the main case with cover.
Figure 4:
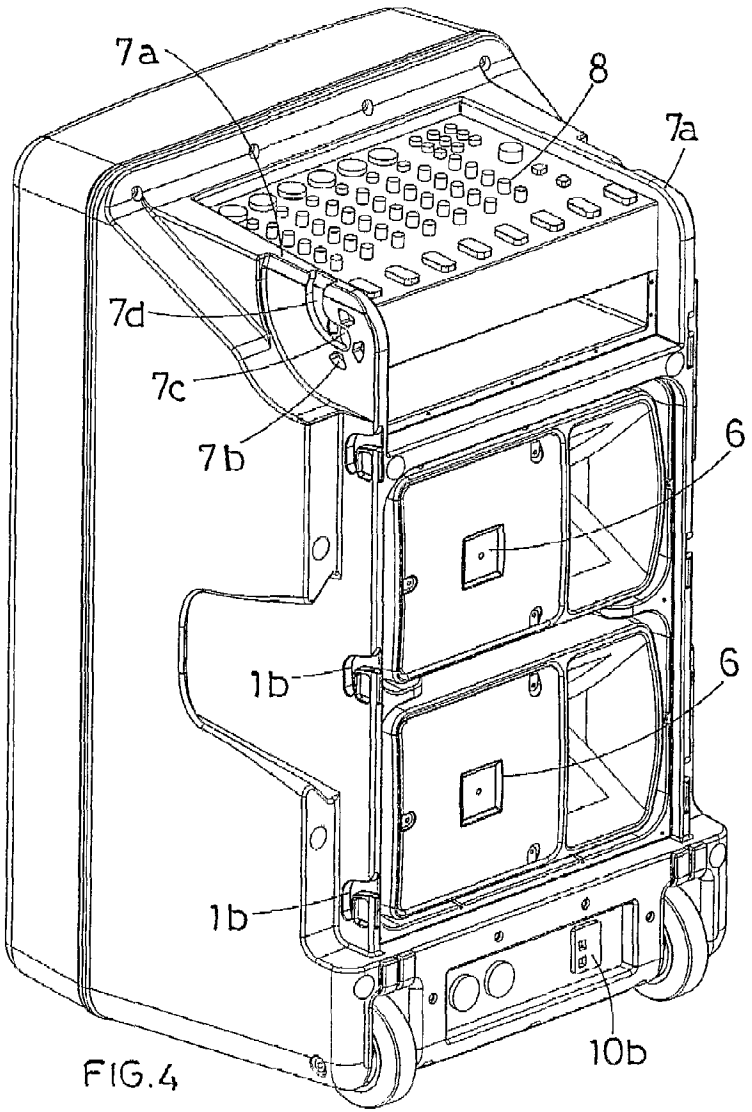
Figure 6:
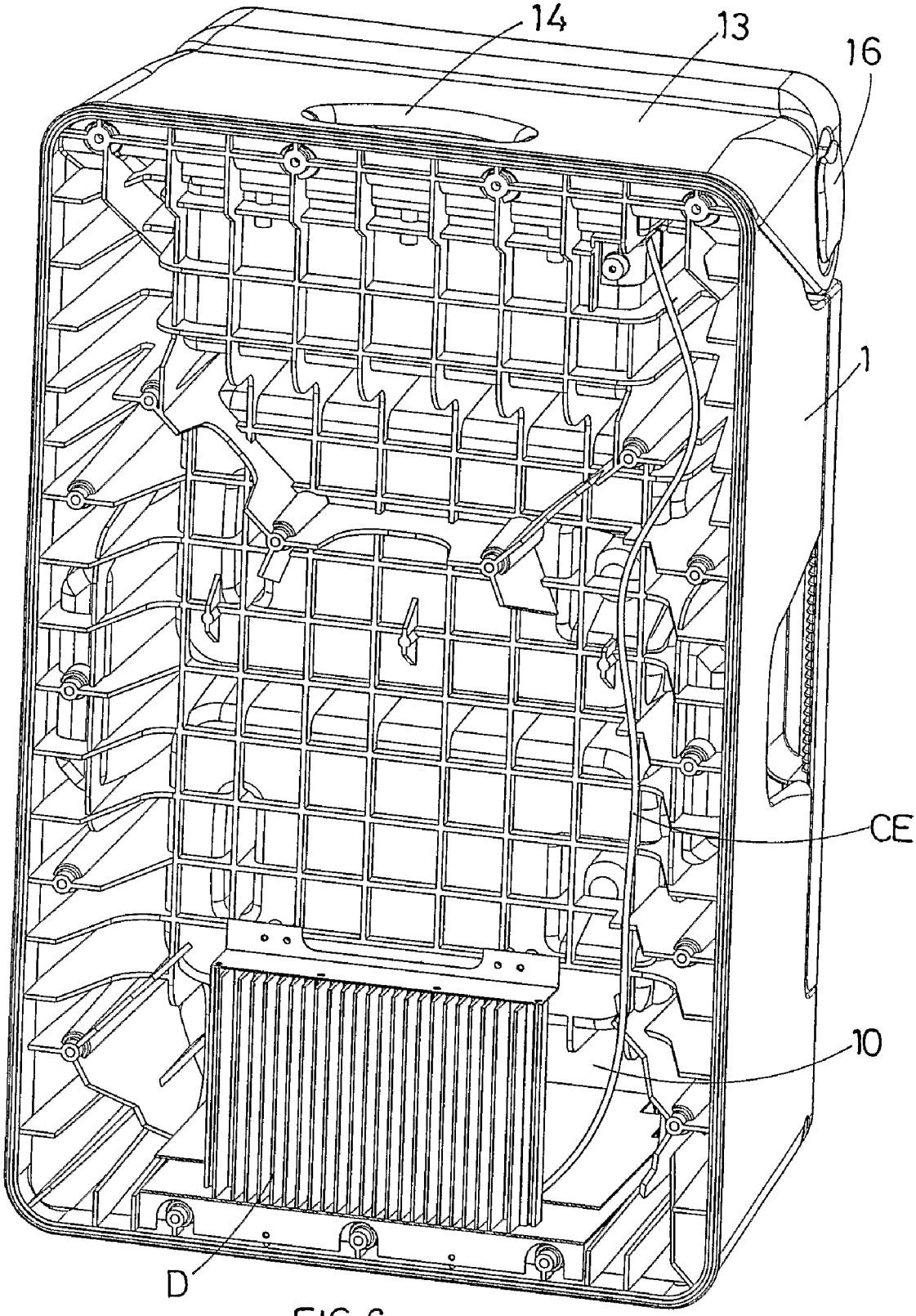
FIG. 6 is an axonometric view of the front of the main case.

As mentioned earlier, the cover (13) can be moved from the horizontal position (shown in FIG. 6), in which it hermetically closes the space (7) for the audio mixer (8), to the vertical position (shown in FIG. 7), which allows to use it as handle when pulling the equipment (1) of the invention.

To advantageously perform both functions, the cover (13) must be held in place in the two aforementioned positions (horizontal and vertical).

To that end, each of the lateral borders (13*b*) of the cover (13) has a basically elliptical housing (13*c*) with vertical direction, from whose bottom wall an hollow block (15) with basically parallelepiped shape projects, with a small through hole (15*a*) in central position.

Each housing (13*c*) is designed to house a boxed-type knob (16) which houses an hollow pin (16*a*) with horizontal axis designed to go through the hole (15*a*) of the block (15).

In particular, the shape and size of the knob (16) are such that the knob (16) can incorporate the block (15) exactly and completely.

The block (15) contains a special disk (17) provided with a rear parallelepiped appendix (17*a*) that can exactly engage in the cavity of the block (15), which partially houses a cylindrical helical spring (18) that extends inside the parallelepiped appendix (17*a*) of the disk (17); in particular, the spring (18) is inserted around a short hollow cylindrical passage (17*b*) that projects from the centre of the parallelepiped appendix (17*a*), against which the hollow pin (16*a*) of the knob (16) is exactly engaged.

Figure 10:
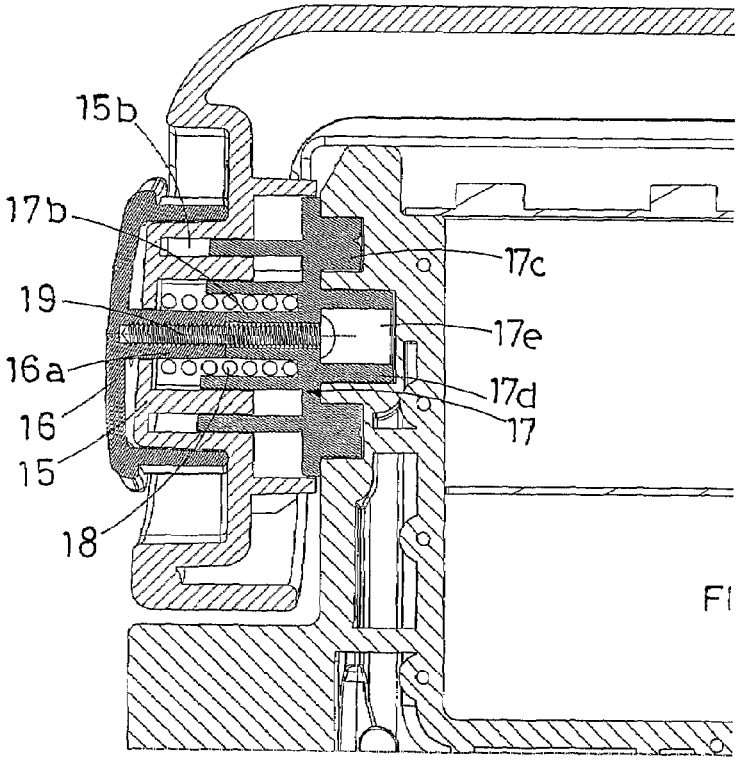
FIG. 10 is a cross-section with a diameter plane in one of the pivoting pins of the cover of the equipment of the invention.

More precisely, FIG. 10 shows the matching of the parallelepiped appendix (17*a*) inside a corresponding niche (15*b*) on the internal side of the block (15) with the possibility of sliding in axial direction.

The matching between the knob (16) and the disk (17) is stable thanks to the presence of a suitable screw (19) that goes through the hollow pin (16*a*) of the knob (16) and the hollow cylindrical passage (17*b*) of the appendix (17*a*) of the disk (17).

FIG. 10 also shows how the screw (19) is inserted through a hole (17*a*) located in axial position in the front pin (17*d*) of the disk (17).

In any case, the matching joins the knob (16) and the disk (17), so that a backward movement of the knob (16) results in the backward movement of the disk (17), thus simultaneously compressing the return spring (18) positioned between the knob (16) and the disk (17).

Moreover, the disk (17) is provided with four special radial ridges (17*c*) spaced by 90°, which can exactly penetrate into a corresponding series of notches (7*b*) located on the external side of the border (7*a*) of the space (7) for the audio mixer (8).

To release the boxed-type cover (13) and rotate it to the opposite stop position, the two knobs (16) must be pulled backwards, thus determining the ejection of the ridges (17*c*) of the disks (17) from the corresponding notches (7*b*) located on the borders (7*a*) of the space (7) for the audio mixer (8).

Once rotation of the cover (13) has been completed, the two knobs (16) are released to cause the spontaneous movement of the ridges (17*c*) of the disks (17) into the corresponding notches (7*b*) located on the borders (7*a*) of the space (7) for the audio mixer (8), thanks to the action of the springs (18).

It appears evident that the prismatic matching totally prevents the free rotation of the cover (13) with respect to the top of the case (1).

Figure 8:
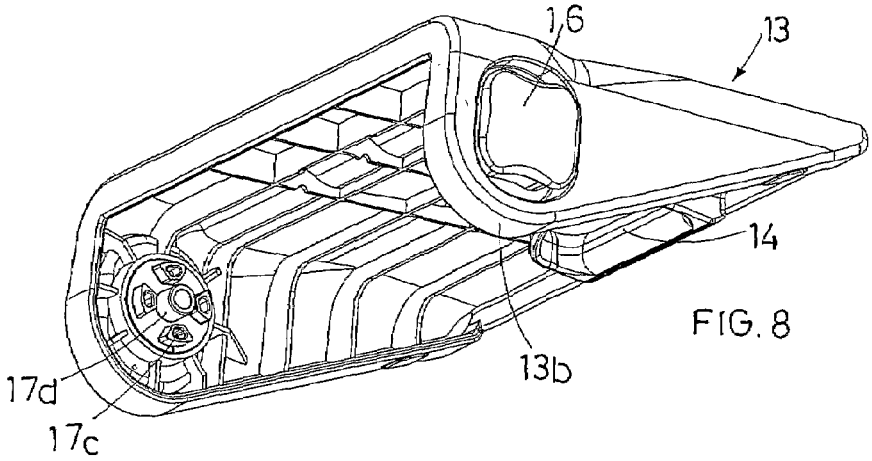
FIG. 8 is a perspective view of the cover used to close the top of the case, in which the lateral fixing means are mounted.
Figure 9:
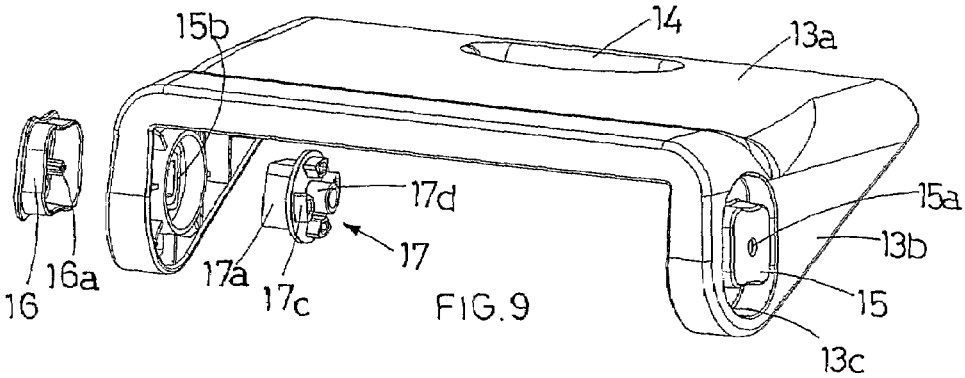
FIG. 9 is the same as FIG. 8, with the only difference that the lateral fixing means are not mounted.

FIGS. 8, 9 and 10 show that each disk (17) has a central pin with circular cross-section (17*d*) with higher length than the radial ridges (17*c*).

The two pins (17*d*) of the two disks (17) are designed to engage into corresponding housings (7*c*) located on the lateral edges (7*a*) of the space (7) for the audio mixer (8), with the possibility to rotate freely. Practically, the pins (17*d*) are designed to favour and guide the alternate rotations of the cover (13).

Naturally, rotations of the pins (17*d*) inside the housings (7*c*) are only possible if the prismatic matching between the ridges (17*c*) that surround each pin (17*d*) and the notches (7*b*) that surround each housing (7*c*) on the borders (7*a*) of the space (7) for the audio mixer (8) is eliminated by pulling the control knobs (16) backwards.

This explains the reason why the pins (17*d*) have a higher length than the ridges (17*c*): the backward travel imposed on the command knobs (16) must eject the shorter ridges (17*c*) from the notches (7*b*) only, without causing the uncoupling of the longer pins (17*d*) from the corresponding rotation housings (7*c*).

However, to remove the cover (13) from the case (1) completely, starting from the stop position of the knobs (16), the pins (17*d*) must be moved upwards along suitable L-shaped grooves (7*d*) that extend from the rotation housings (7*c*) to the upper horizontal edge of each lateral border (7*a*) of the space (7) for the audio mixer (8) and allow the pins to be completely uncoupled from the borders (7*a*).

The invention claimed is:

1. Electro acoustic equipment comprising a loudspeaker for the reproduction of low frequencies (2), two satellites (6), an audio mixer (8) and a power unit, characterised by the fact that it is composed of:

a main case (1) that has a front space (1*a*) having the same height as the case (1), which partially houses the speaker (2) and closed by a suitable box-shaped cover (3) with a grid (4) that hides an opening (3*a*) through which the speaker (2) is inserted and fixed, while the back of the case (1) has a lower space (10) used to house a power unit with heat dissipator (D), together with a pair of identical intermediate spaces (5) that exactly house the two satellites (6);

a panel (9) with an upper wing (9*a*) basically folded at 90° inwards, designed to be mounted in stable position on the back of the case (1), in order to close the two spaces (5) for the satellites (6) and embrace the first rear section of the upper housing (7) for the audio mixer (8);

a boxed-type removable cover (13), hinged to the lateral borders (7*a*) of the space (7) for the audio mixer (8), capable of oscillating from the horizontal stop position, when it perfectly closes the space (7), to a vertical stop position, in which it is flush with the back wall of the case (1) and used as handle to pull the equipment of the invention, thanks to the presence of a notch-handle (14) near the free horizontal edge;

a pair of wheels (12) fixed inside two small vertical housings (11) with pins with horizontal axis, which are located on the bottom and back of the case (1), in lateral position with respect to the space (10) for the power unit;

an electrical cable (CE), housed in the front space (1*a*) of the case (1), used to make the electrical connection between the audio mixer (8) contained in the upper space (7) and the power unit housed in the lower space (10).

2. Electro acoustic equipment as defined in claim 1, characterised by the fact that the back closing panel (9) is fixed in stable position to the case (1) thanks to the presence of pegs (9*b*) with horizontal axis in internal position on the lateral uprights, suitable to be coupled with corresponding slots (1*b*) with overturned-L shape located on the external sides of the case (1).

3. Electro acoustic equipment as defined in claim 1, or in both the preceding claims, characterised by the fact that the panel (10*a*) of the power unit housed in the bottom space (10) is flush with the opening of the space (10) and incorporates the electrical socket(10*b*) used to power the equipment and two connectors (10*c*) for the two satellites (6).

4. Electro acoustic equipment as defined in one or more of the preceding claims, characterised by the fact that each back space (5) designed to house the satellites (6) has two bulges (5*a*, 5*b*) on the bottom vertical wall, the first bulge with horizontal position and the second bulge with vertical position, which are designed to exactly penetrate inside corresponding niches (6*a*, 6*b*) provided on the back of the satellites (6).

5. Electro acoustic equipment as defined in one or more of the preceding claims, characterised by the fact that the top cover (13) is provided with two lateral borders (13*b*), each of them with a basically elliptical housing (13*c*) with vertical direction in the rear end, from whose bottom wall an hollow block (15) with basically parallelepiped shape projects, with a small through hole in the centre (15*a*), into which the hollow pin (16*a*) of a boxed-type knob (16) is exactly engaged, which can incorporate the corresponding block (15) exactly and completely; it being provided that the niche (15*b*) on the internal side of the hollow block (15) is designed to contain exactly, with the interposition of a spring (18), the basically parallelepiped rear appendix (17*a*) of a disk (17) with a small hollow cylindrical passage (17*b*) in central position that can be perfectly aligned with the pin (16*a*) of the knob (16), in such a way that both can be simultaneously traversed by a screw with horizontal axis (19) applied in this position through a central hollow pin (17*d*) that projects from the centre of the front side of the disk (17) and is surrounded by four radial ridges (17*c*), spaced by 90° and provided with lower length with respect to it; it being provided that the ridges (17*c*) and the central cylindrical pin (17*d*) in intermediate position are designed to engage respectively into corresponding notches (7*b*) located in useful position on the lateral border (7*a*) of the space (7) for the audio mixer (8) and into a corresponding circular housing (7*c*) located in central position in the notches (7*b*), from which a basically L-shaped groove (7*d*) starts, ending at the top of the border (7*a*), which contains and guides the travels of the central pin (17*d*) of the disk (17) when the cover (13) is removed.

* * * * *